US010668492B2

(12) United States Patent
Brannon et al.

(10) Patent No.: US 10,668,492 B2
(45) Date of Patent: Jun. 2, 2020

(54) VENTED CLOSURE ASSEMBLY FOR A SPRAY CONTAINER

(71) Applicant: Silgan Dispensing Systems Slatersville LLC, Slatersville, RI (US)

(72) Inventors: Patrick J. Brannon, Warwick, RI (US); Clifford Skillin, Blackstone, MA (US)

(73) Assignee: Silgan Dispensing Systems Slatersville LLC, Slatersville, RI (US)

( * ) Notice: Subject to any disclaimer, the term of this patent is extended or adjusted under 35 U.S.C. 154(b) by 0 days.

(21) Appl. No.: 16/214,250

(22) Filed: Dec. 10, 2018

(65) Prior Publication Data

US 2019/0105677 A1 Apr. 11, 2019

Related U.S. Application Data

(62) Division of application No. 14/774,454, filed as application No. PCT/US2014/025209 on Mar. 13, 2014, now Pat. No. 10,201,821.

(60) Provisional application No. 61/788,362, filed on Mar. 15, 2013, provisional application No. 61/788,089, filed on Mar. 15, 2013, provisional application No. 61/789,197, filed on Mar. 15, 2013.

(51) Int. Cl.

| | |
|---|---|
| ***B05B 11/00*** | (2006.01) |
| ***B65D 41/04*** | (2006.01) |
| ***B65D 47/08*** | (2006.01) |

(52) U.S. Cl.

CPC ..... *B05B 11/0044* (2018.08); *B05B 11/0008* (2013.01); *B05B 11/0027* (2013.01); *B65D 41/04* (2013.01); *B65D 47/08* (2013.01); *B05B 11/00412* (2018.08)

(58) Field of Classification Search

CPC ..... B05B 11/0044; B05B 11/0008; B05B 11/0027; B05B 11/00412; B05B 11/0016; B05B 41/07; B05B 47/08

USPC ..... 215/44

See application file for complete search history.

(56) References Cited

U.S. PATENT DOCUMENTS 4,222,500 A * 9/1980 Capra ..... B05B 9/0883 222/207
4,485,943 A * 12/1984 Czech ..... B05B 11/3015 222/256
5,328,062 A * 7/1994 Tubaki ..... B05B 9/0883 222/385
5,492,252 A * 2/1996 Gueret ..... B05B 11/0029 222/207

(Continued)

*Primary Examiner* — Ernesto A Grano

(74) *Attorney, Agent, or Firm* — Barlow, Josephs & Holmes, Ltd.

(57) ABSTRACT

A closure assembly includes a vented closure and a dispensing fitment. The closure includes an upper deck, a tubular hub extending downwardly from the upper deck, an annular outwardly threaded fitment neck extending upwardly from the upper deck, and a fitment seat surrounding the fitment neck. The fitment seat has a vent hole radially spaced from the hub. The dispensing fitment includes a fitment body, an arbor extending downwardly from the fitment body, an annular inwardly threaded sealing wall extending downwardly from the fitment body, and a dispensing neck extending upwardly from the fitment body. The arbor is movable between an open venting position and a closed position which blocks the vent hole.

11 Claims, 15 Drawing Sheets

(56) References Cited

U.S. PATENT DOCUMENTS 5,605,257 A * 2/1997 Beard ..... B05B 11/0072 222/189.09
6,192,797 B1 * 2/2001 Rea ..... B41F 31/08 101/202
6,708,852 B2 * 3/2004 Blake ..... B05B 9/0883 222/207
7,661,546 B2 * 2/2010 Jiang ..... A61J 9/006 215/11.1
8,083,107 B2 * 12/2011 Laible ..... B65D 47/32 222/189.09
9,409,682 B2 * 8/2016 Newsom ..... B65D 1/023
9,751,102 B2 * 9/2017 Blake ..... F04B 35/01
2003/0042274 A1 * 3/2003 Johanson ..... B41J 2/17523 222/387
2005/0155980 A1 * 7/2005 Neuhalfen ..... B65D 83/38 222/95
2006/0283896 A1 * 12/2006 Kasting ..... B65D 47/24 222/549
2007/0262100 A1 * 11/2007 Murray ..... B65D 47/147 222/525
2008/0053568 A1 * 3/2008 Johnson ..... B67D 1/0082 141/383
2009/0057347 A1 * 3/2009 Leys ..... B65D 83/0055 222/386.5
2012/0018431 A1 * 1/2012 Wu ..... B65D 47/0895 220/259.4
2012/0140453 A1 * 6/2012 Lin ..... B25B 13/463 362/119
2013/0175273 A1 * 7/2013 Fox ..... B65D 25/48 220/259.3
2013/0230423 A1 * 9/2013 Faneca Llesera ... B05B 11/3026 92/248
2013/0306681 A1 * 11/2013 Muller ..... B05B 11/0056 222/183
2014/0076934 A1 * 3/2014 Laib ..... B65D 49/00 222/147
2014/0217124 A1 * 8/2014 Kim ..... B05B 1/3415 222/321.9
2014/0353274 A1 * 12/2014 Benson ..... B65D 41/04 215/43
2015/0343470 A1 * 12/2015 Chang ..... B65D 47/2012 239/327
2016/0074889 A1 * 3/2016 Santagiuliana ..... B05B 11/3004 222/380
2017/0121168 A1 * 5/2017 Johnson ..... B65D 75/5877
2017/0297779 A1 * 10/2017 Im ..... B65D 41/04
2019/0256341 A1 * 8/2019 Stever ..... B65D 77/067

* cited by examiner

VENTED CLOSURE ASSEMBLY FOR A SPRAY CONTAINER

CROSS-REFERENCE TO RELATED APPLICATIONS

This application is a division of U.S. application Ser. No. 14/774,454, filed Sep. 10, 2015, which is a non-provisional filing of, and claims the benefit of, U.S. Provisional Application No. 61/788,089, filed Mar. 15, 2013, U.S. Provisional Application No. 61/788,362, filed Mar. 15, 2013, and U.S. Provisional Application No. 61/789,197, filed Mar. 15, 2013, the entire contents of which are all incorporated herein by reference.

BACKGROUND

The instant invention relates to closures for spray bottles, and more particularly to vented closure assemblies having a vent that opens to facilitate spraying.

SUMMARY

An exemplary embodiment describes a vented closure assembly for a container of a spray system where the closure assembly includes a closure and a separate dispensing fitment which are threaded to create a rotatable linear translation of the fitment.

The closure includes a closure body, a closure cap, and a living hinge connecting the closure cap to the closure body. During shipment, sale and storage the dispensing fitment is removed and the closure cap closed to fully seal the closure and container. In use, the operator opens the cap and assembles the dispensing fitment with the closure.

The closure body has an upper deck, a tubular hub extending downwardly from the upper deck, an annular outwardly threaded fitment neck extending upwardly from the upper deck and surrounding the hub, an annular recessed fitment seat surrounding the fitment neck, and a skirt extending downwardly from the closure deck for engagement with the container. The hub has a bottom wall and an entrance orifice within the bottom wall. The hub further includes a sleeve wall extending downwardly from the bottom wall for receiving therein a sprayer dispensing tube which extends from the bottom of the hub downwardly to the bottom of the container. In accordance with the invention, the recessed fitment seat has a vent hole radially spaced from the hub.

The dispensing fitment includes a fitment body, an arbor extending downwardly from the fitment body, an annular inwardly threaded sealing wall extending downwardly from the fitment body, a dispensing neck extending upwardly from the fitment body, and a flow conduit extending longitudinally through the arbor, the fitment body and the dispensing neck.

To assemble the components, the inwardly threaded sealing wall is threadably received with the outwardly threaded fitment neck of the closure while the arbor of the fitment is slidably and rotatably received in interfitting mated engagement within the hub. The dispensing fitment is thereafter rotatably and linearly movable relative to the closure body between a lower closed position in which a lower peripheral edge of the fitment sealing wall is in engagement with the recessed fitment seat to block the vent hole, and an upper open position in which the lower peripheral edge of the fitment sealing wall is spaced upwardly from the vent hole allowing air to pass through the vent hole.

The dispensing fitment preferably includes a radially extending actuator arm which is selectively manipulated by the user to rotate the fitment between the open and closed positions.

In order to facilitate proper rotational positioning of the fitment, the dispensing fitment includes a locating tab which engages with circumferentially spaced locating stops on the upper deck corresponding to the open and closed positions. In the preferred embodiment, the locating tab is formed on the bottom of the actuator arm.

A second exemplary embodiment includes a closure and a dispensing fitment which is rotatable (but not threaded).

The closure includes a closure body, a closure cap, and a living hinge connecting the closure cap to the closure body. During shipment, sale and storage the dispensing fitment is removed and the closure cap closed to fully seal the closure and container. In use, the operator opens the cap and assembles the dispensing fitment with the closure.

The closure body has an upper deck, a tubular hub extending downwardly from the upper deck, a recessed fitment seat surrounding the hub, and an outer skirt extending downwardly from the closure deck for engagement with the container. The hub has a bottom wall and an entrance orifice within the bottom wall. The hub further includes a sleeve wall extending downwardly from the bottom wall for receiving therein a sprayer dispensing tube which extends from the bottom of the hub downwardly to the bottom of the container. In accordance with the invention, the recessed seat has a vent hole radially spaced from the hub.

The dispensing fitment includes a fitment body, an arbor extending downwardly from the fitment body, a cantilevered arm extending radially outwardly from the arbor, a vent plug extending downwardly from a distal end of the cantilevered arm, a dispensing neck extending upwardly from the fitment body, and a flow conduit extending longitudinally through the arbor, the fitment body and the dispensing neck.

To assemble the components, the arbor of the fitment is slidably received in interfitting mated engagement within the hub such that cantilever arm rests on the upper surface of the recessed fitment seat. The dispensing fitment is thereafter rotatably movable relative to the closure body between an open venting position where the vent plug on the end of the cantilever arm is circumferentially displaced from, and not engaged with, the vent hole, and a closed position where the vent plug is circumferentially aligned with, and engaged with the vent hole. The cantilever arm is flexible to provide a spring bias for firm engagement of the vent plug with the vent hole. To maintain the dispensing fitment in assembled relation with the closure body, the arbor includes an annular locking ledge on an outside surface thereof which engages with a complementary annular groove formed on an inner surface of the hub. When assembled the annular ledge is snap received within the groove to prevent relative linear movement of the parts, but still allows for rotation of the arbor relative to the inner wall of the hub.

The dispensing fitment preferably includes a radially extending actuator arm which is selectively manipulated by the user to rotate the fitment between the open and closed positions.

In order to facilitate proper rotational positioning of the fitment, the dispensing fitment includes a locating tab which engages with circumferentially spaced locating stops on the upper deck corresponding to the open and closed positions. In the preferred embodiment, the locating tab is formed on the bottom of the actuator arm.

A third exemplary embodiment includes a closure and a dispensing fitment which is linearly movable (push-pull) (but not threaded).

The closure includes a closure body, a closure cap, and a living hinge connecting the closure cap to the closure body. During shipment, sale and storage the dispensing fitment is removed and the closure cap closed to fully seal the closure and container. In use, the operator opens the cap and assembles the dispensing fitment with the closure.

The closure body has an upper deck, a tubular hub extending downwardly from the upper deck, a recessed fitment seat surrounding the hub, and an outer skirt extending downwardly from the closure deck for engagement with the container. The hub has a bottom wall and an entrance orifice within the bottom wall. The hub further includes a sleeve wall extending downwardly from the bottom wall for receiving therein a sprayer dispensing tube which extends from the bottom of the hub downwardly to the bottom of the container. In accordance with the invention, the recessed seat has a vent hole radially spaced from the hub.

The dispensing fitment includes a fitment body having an annular sealing platform extending radially outwardly from the fitment body, a lower sealing surface formed on the sealing platform, an arbor extending downwardly from the fitment body, a dispensing neck extending upwardly from the fitment body, and a flow conduit extending longitudinally through the arbor, the fitment body and the dispensing neck.

To assemble the components, the arbor of the fitment is slidably received in interfitting mated engagement within the hub such that the lower surface of the annular sealing platform is positioned in facing engagement with the recessed seat. The dispensing fitment is linearly movable relative to the closure between a lower closed position in which the lower surface of the annular sealing platform engages the recessed fitment seat and blocks the vent hole, and an open venting position in which the lower surface of the annular sealing platform is spaced upwardly from the recessed fitment seat and allows air to pass through the vent hole.

To maintain the dispensing fitment in assembled relation with the closure body, the arbor includes an annular locking ledge on an outside surface thereof which engages with a complementary annular groove formed on an inner surface of the hub.

When assembled the annular locking ledge is snap received within the groove to limit relative linear movement of the parts, but still allows for linear displacement of the arbor relative to the inner wall of the hub between the open venting position and the lower closed position. In order to facilitate proper linear positioning of the fitment, the annular locking ledge is linearly displaceable within the annular groove formed on an inner surface of the hub. The annular groove has a lower edge wall corresponding to the lower closed position and an upper edge wall corresponding to the open venting position. The locking ledge and the groove cooperate to maintain the dispensing fitment in assembled relation with the closure body and provide positive locating positions of the dispensing fitment relative to the closure.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE EXEMPLARY EMBODIMENTS

Figure 1:
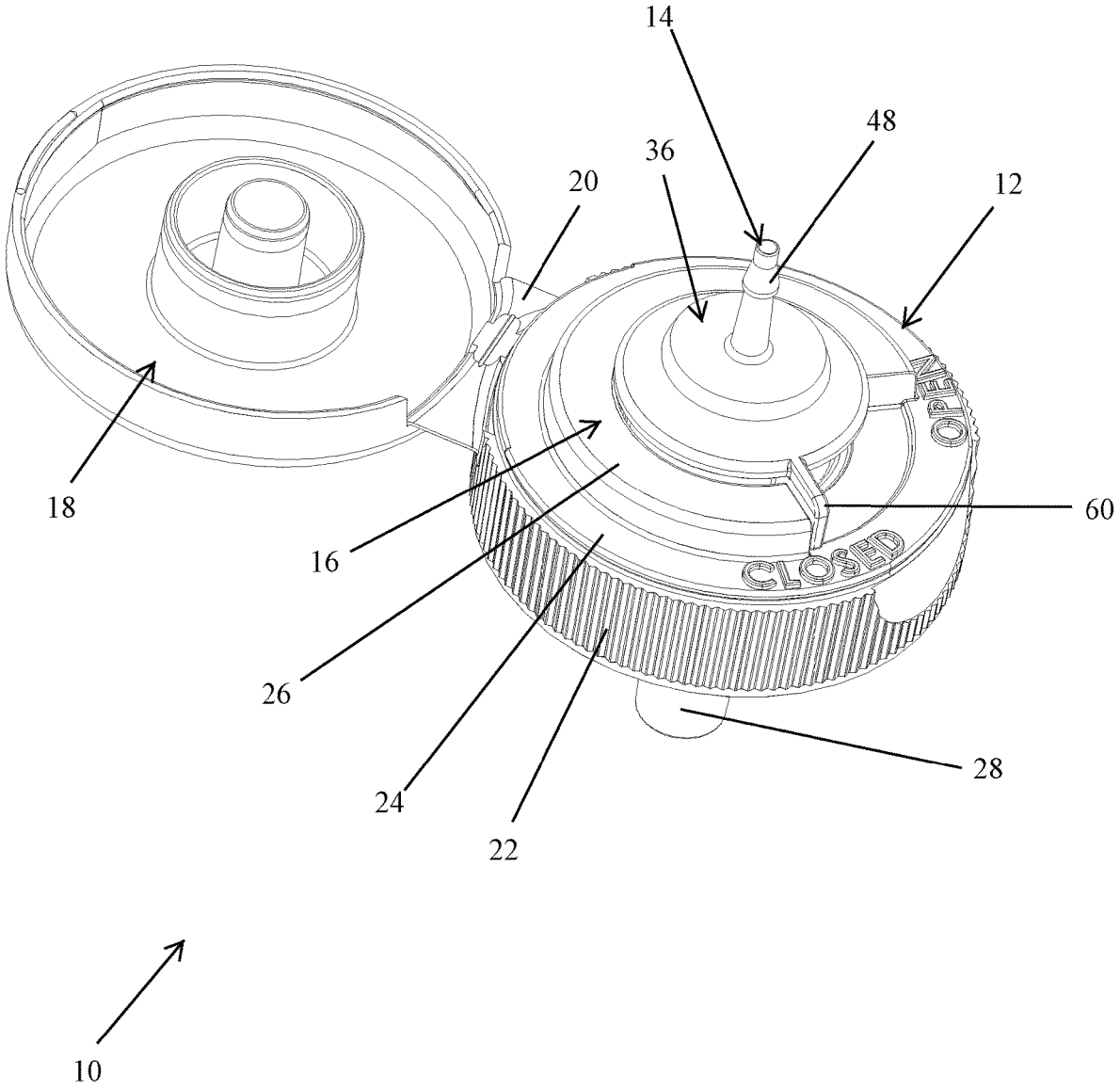
FIG. 1 is a perspective view of one exemplary embodiment of a closure assembly of the present invention.
Figure 2:
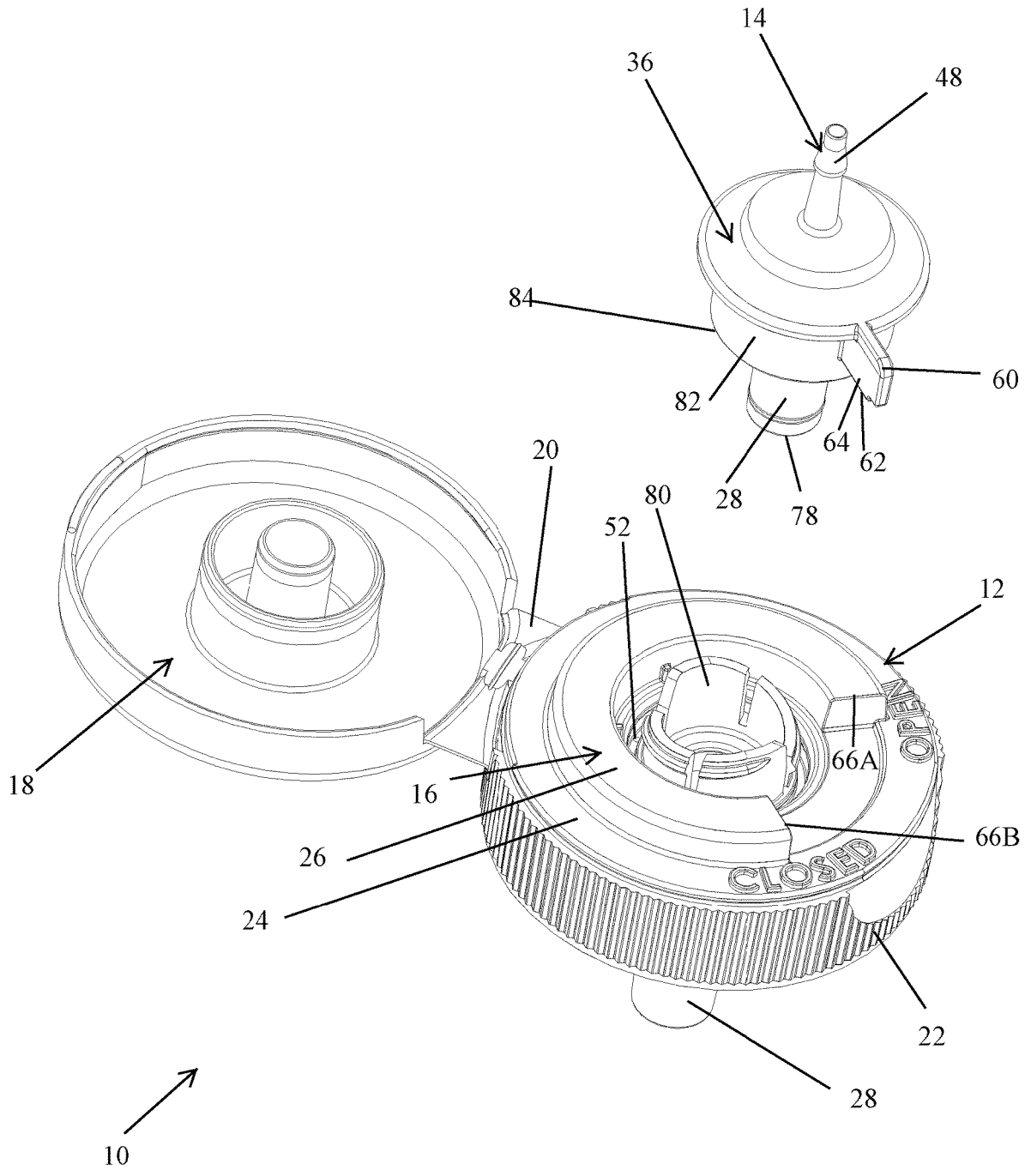
FIG. 2 is an exploded view thereof.

Referring now to the drawings, an exemplary embodiment of the closure assembly is illustrated and generally indicated at 10 in FIGS. 1-5. As will hereinafter be more fully described, the instant closure assembly includes a vented closure and a dispensing fitment that form a vented closure assembly with a rotatable and linearly movable vented plug for a container (not shown).

The closure assembly 10 of the present invention includes a closure 12 and a dispensing fitment 14 that cooperate to provide a rotatable venting arrangement, which is particularly useful for spray bottles for home and garden products. The closure 12 and dispensing fitment 14 are provided separately to the consumer, with the closure 12 removably secured to a spray bottle or other container. When ready to use the product, the consumer may assemble the dispensing fitment 14 with the closure, as described below, and then connect the hose portion of a spray handle (not shown) to the dispensing fitment 14 in order to dispense a product from the container.

FIG. 1 shows a perspective view of the closure 12 and the dispensing fitment 14 of the closure assembly 10. The closure 12 has a closure body 16 and a closure cap 18, which may be connected by a living hinge 20 that allows the cap 18 to be moved from an open position to a closed position or may be two separate components capable of being snap fit or otherwise connected. The manufacturer secures the closure body to a container by way of an inwardly threaded skirt 22 that extends downwardly from the closure deck 24 that engages an outwardly threaded neck portion of the container, and then the manufacturer closes the closure cap 18 against the closure body 16 to seal the container.

The closure body also has an upper deck 26, and a tubular hub 28 that extends downwardly from the upper deck 26 for receiving the dispensing fitment 14 when the closure cap 18 is in an open position, as shown in FIG. 1. The tubular hub 28 has a bottom wall 30 and an entrance orifice 32 defined within the bottom wall for receiving the dispensing fitment (see FIG. 4).

Figure 3:
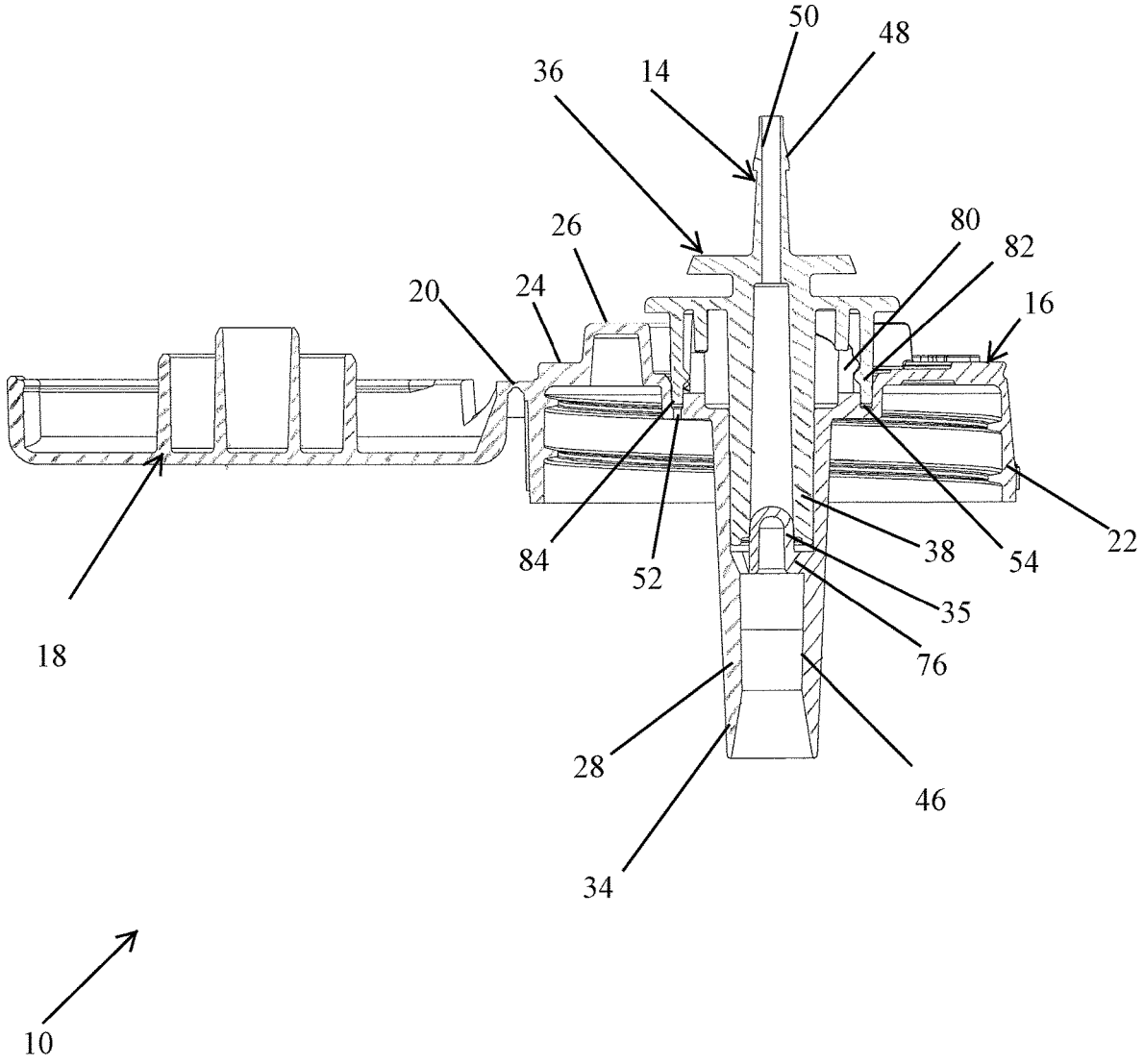
FIG. 3 is a cross-sectional view of the closure assembly of FIG. 1.

Extending downwardly from the bottom wall 30 is a sleeve wall 34 for receiving a dispensing tube (not shown), which runs to the bottom of the container. The dispensing tube provides a path through which liquid may be drawn from the bottom of the container to the tubular hub 28 so that it may be dispensed through the fitment body 36 and then through the trigger sprayer. FIG. 3 shows how the sleeve wall 34, tubular hub 28, and dispensing fitment 14 provide a path for a liquid to flow from a dispensing tube received in the sleeve wall 34 and then through the dispensing fitment 14, though the path is blocked by the sealing boss 35 in FIG. 3, as discussed below.

The dispensing fitment 14 has a fitment body 36 that can be assembled with the closure body 16 to form the closure assembly 10 shown in FIG. 1. The fitment body 36 has an arbor 38 that extends downwardly from the fitment body 36 that is rotatably and slidably received within the hub 28 of the closure body 16 as will be described further herein.

Figure 4:
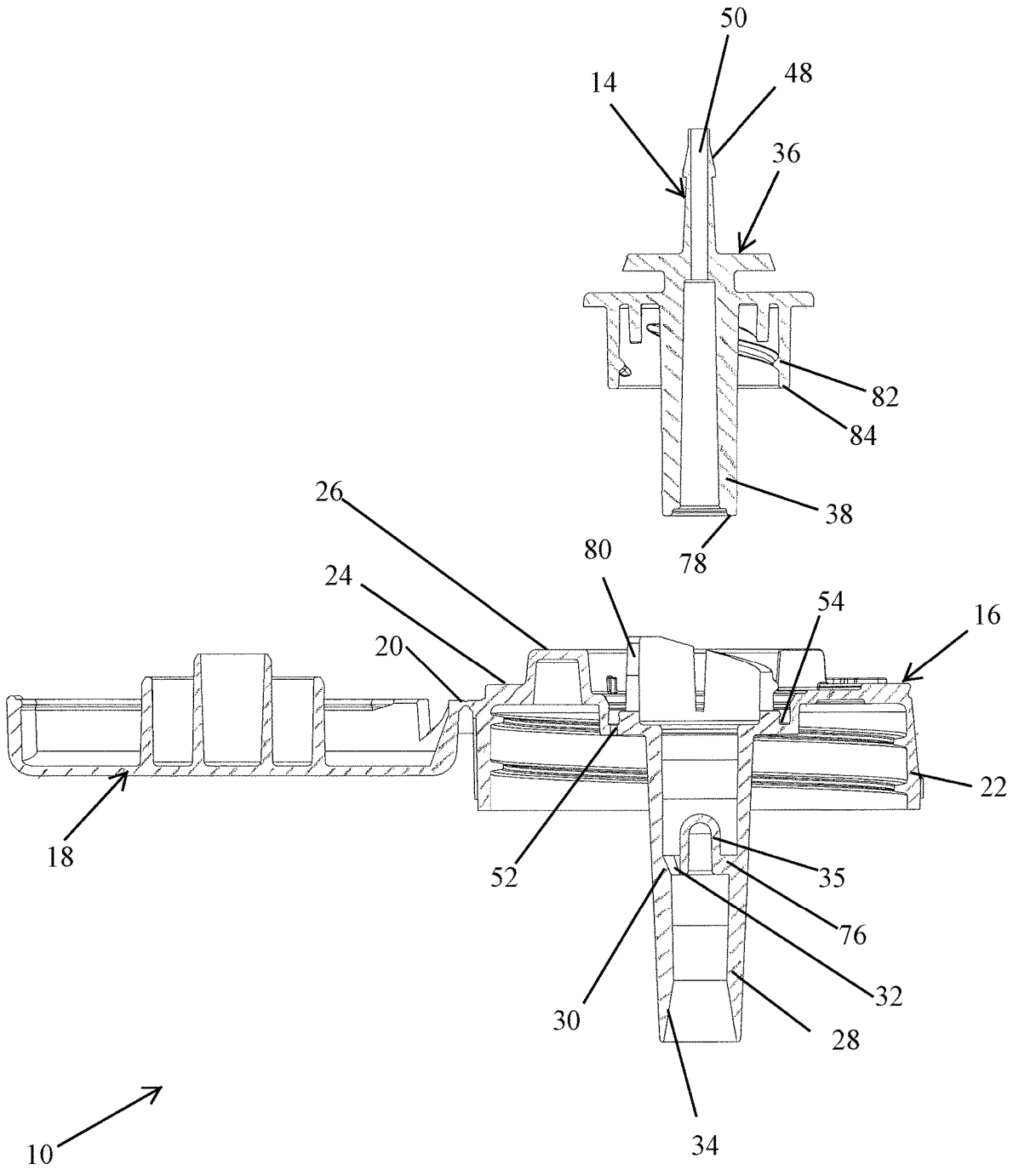
FIG. 4 is an exploded view thereof.
Figure 5:
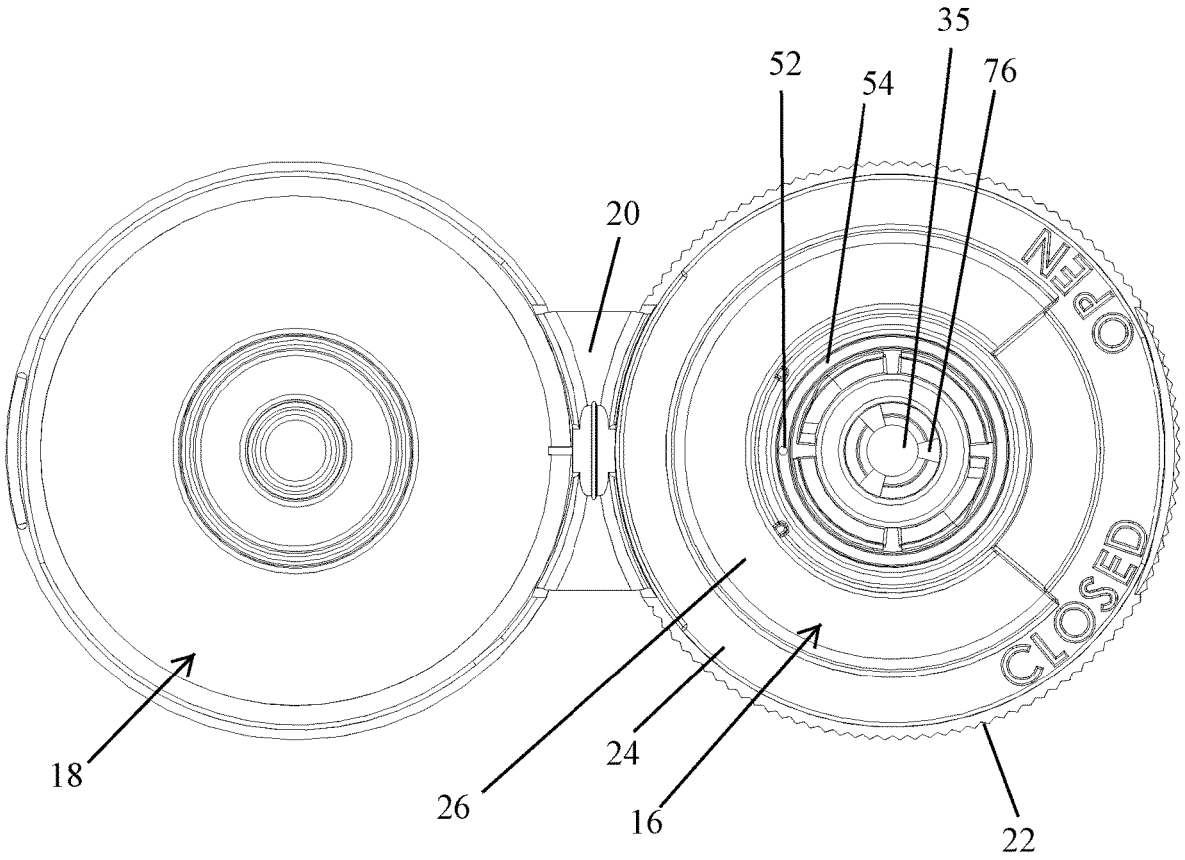
FIG. 5 is a top view of the closure with the dispensing fitment removed.

To allow the product to be dispensed from the container, a dispensing neck 48 extends upwardly from the fitment body 36, and a flow conduit 50 extends longitudinally through the arbor 38, the fitment body 36 and the dispensing neck 48, as shown in the cross sectional view of FIG. 4. The dispensing neck 48 may be configured and arranged to receive the hose portion of a spray handle.

When a liquid volume is dispensed from a container using a trigger sprayer and air is not allowed to enter the container, the container walls begin to collapse inwards. This decreases the ability of the trigger sprayer to dispense liquid from the container, and it may cease the operation of the trigger sprayer entirely. The instant invention addresses this problem by including a sealable vent hole 52 defined on a recessed fitment seat 54 surrounding the hub 28, and radially spaced from the hub 28.

However, when using a container in a trigger spray system, it is also desirable for the user to be able to prevent bottle leakage when the liquid container is not in use. The instant invention allows the user to seal the vent hole 52 as needed to prevent inadvertent bottle leakage. As described below, the dispensing fitment 14 enables the consumer to selectively plug and open the vent hole 52 by rotating the fitment body 36 relative to the hub 28 of the closure body 16 to cause the fitment body 36 to move linearly within the hub 28.

An annular outwardly threaded fitment neck 80 extends upwardly from the upper deck 26 of the closure body 16 and surrounds the hub 28. An annular fitment seat 54 surrounds the threaded fitment neck 80. On the fitment body 36, an annular inwardly threaded sealing wall 82 extends downwardly from the fitment body. This inwardly threaded sealing wall 82 is threadably received with the outwardly threaded fitment neck 80 of the closure, and the arbor 38 is slidably and rotatably received in interfitting mating relation within the hub 28 of the closure body 16 so that the sealing wall 82 can be positioned in facing engagement with the recessed seat 54. Thus, the consumer may rotate the dispensing fitment 14 between an open venting position in which the sealing wall 82 is linearly displaced upwardly and not engaged with the recessed seat 54 and a closed position in which the sealing wall 80 engages the recessed seat 54 and blocks air flow through the vent hole 52. FIGS. 1 and 3 show the fitment body 36 in the closed position so that the sealing wall 82 seals the recessed seat 54 to prevent air flow through the vent hole 52.

In order to facilitate rotation of the dispensing fitment 14 within the hub 28 of the closure body 16, the dispensing fitment may include a radially extending actuator arm 60. To further facilitate rotation of the dispensing fitment 14 between the closed position and the open position, the lower surface 62 of the actuator arm 60 may include a locating tab 64 that extends downwardly from the actuator arm 60 and is capable of engaging a stop 66A corresponding to an open position and a stop 66B corresponding to the closed position. These stops 66A, 66B are circumferentially spaced on the closure deck 24 such that when a user rotates the actuator arm 60 until the locating tab 64 contacts the stop 66B corresponding the closed position, the lower peripheral edge 84 of the fitment sealing wall 82 is in engagement with the recessed fitment seat 54 to block the vent hole 52.

The closure assembly 10 may further include a sealing boss 35 within the flow conduit. The sealing boss 35 is connected to the hub 28 by a plurality of connecting ribs 76. The sealing boss 35 engages a lower end 78 of the arbor 28 when the dispensing fitment 14 is in the closed position, to prevent fluid from passing through the flow conduit 50. As the fitment 14 is rotated the bottom end of the arbor 38 is lifted out of engagement with the boss 35 to open the flow conduit.

Another exemplary embodiment of the closure assembly of the instant invention is illustrated and generally indicated at 110 in FIGS. 6-10. As will hereinafter be more fully described, the instant closure assembly includes a vented closure and a dispensing fitment that form a vented closure assembly with a rotatable vented plug for a container (not shown). The dispensing fitment is rotatable but not threaded.

The closure assembly 110 of the present invention includes a closure 112 and a dispensing fitment 114 that cooperate to provide a rotatable vented plug, which is particularly useful for spray bottles for home and garden products. The closure 112 and dispensing fitment 114 are provided separately to the consumer, with the closure removably secured to a spray bottle or other container. When ready to use the product, the consumer may insert the dispensing fitment 114 into the closure 112, as described below, and then connect the hose portion of a spray handle to the dispensing fitment in order to dispense a product from the container.

Figure 6:
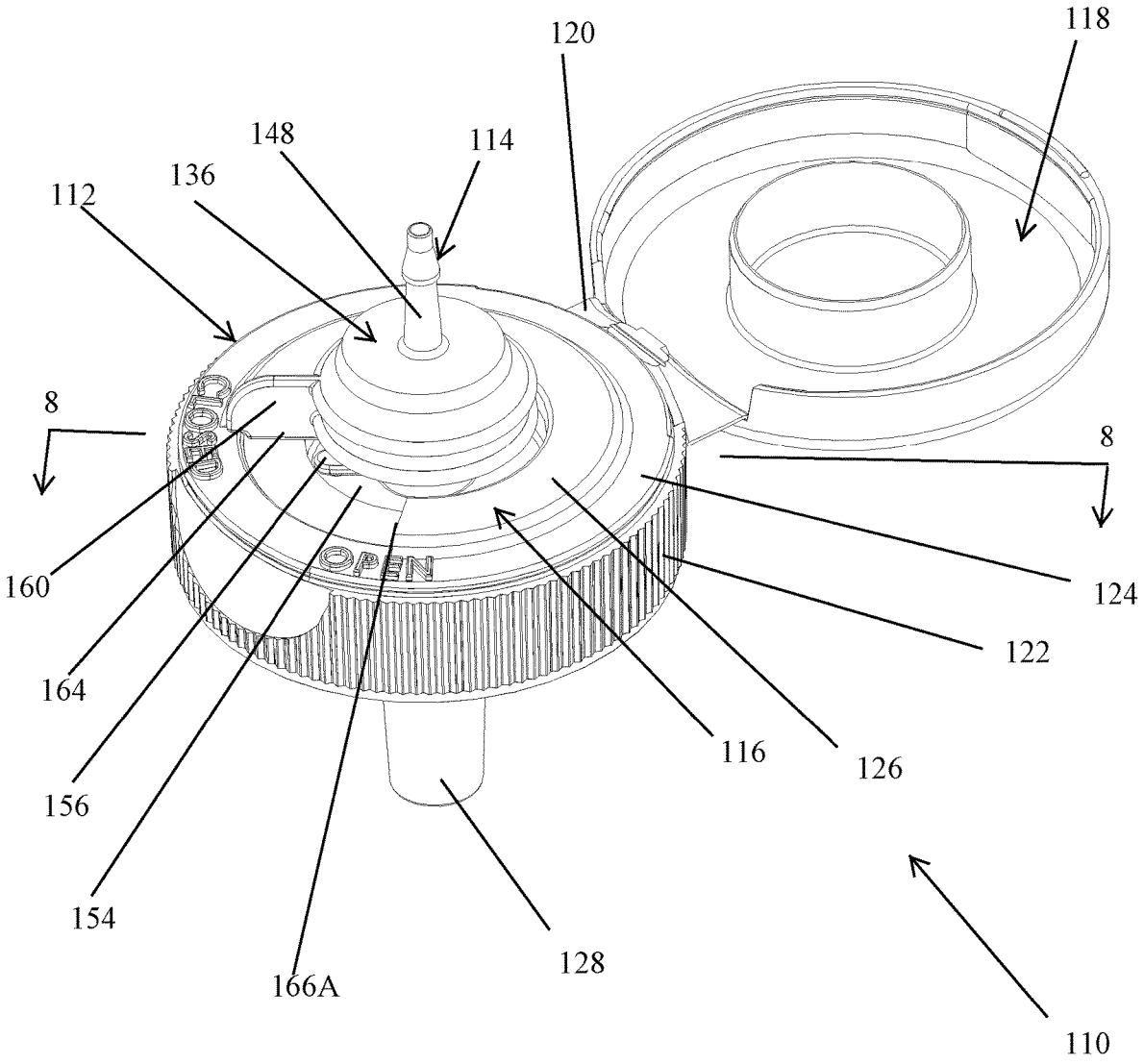
FIG. 6 is a perspective view of another exemplary embodiment of the closure assembly of the present invention.

FIG. 6 shows a perspective view of the closure 112 and the dispensing fitment 114 of the closure assembly 110. The closure 112 has a closure body 116 and a closure cap 118, which may be connected by a living hinge 120 that allows the cap to be moved from an open position to a closed position or may be two separate components capable of being snap fit or otherwise connected. The manufacturer secures the closure body 116 to a container by way of an inwardly threaded skirt 122 that extends downwardly from the closure deck 124 that engages an outwardly threaded neck portion of the container, and then the manufacturer closes the closure cap against the closure body to seal the container.

Figure 7:
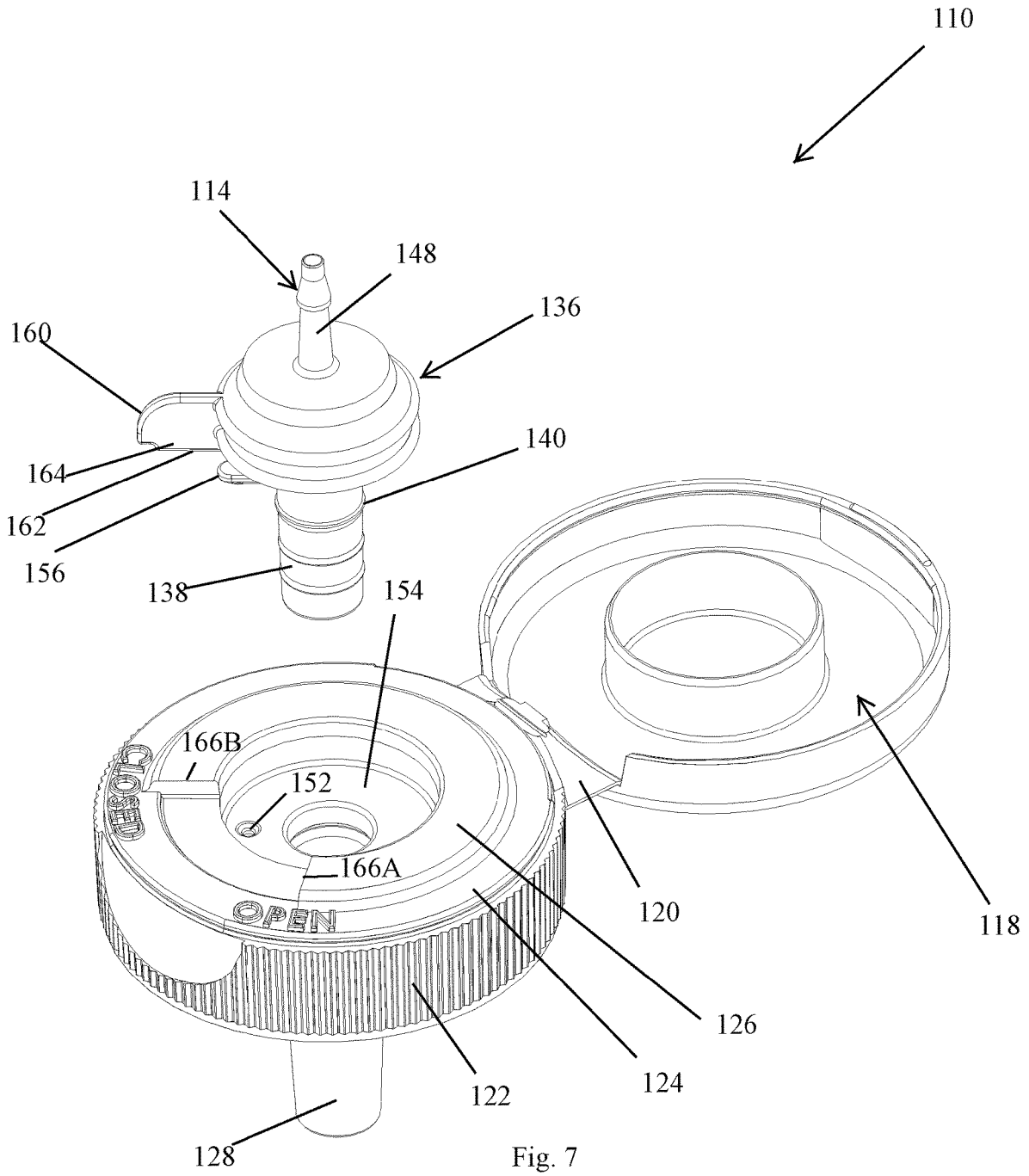
FIG. 7 is an exploded view thereof.

The closure body 116 also has an upper deck 126, and a tubular hub 128 that extends downwardly from the upper deck 126 for receiving the dispensing fitment when the closure cap 118 is in an open position, as shown in FIGS. 6 and 7. The tubular hub 128 has a bottom wall 130 and an entrance orifice 132 defined within the bottom wall 130.

Figure 8:
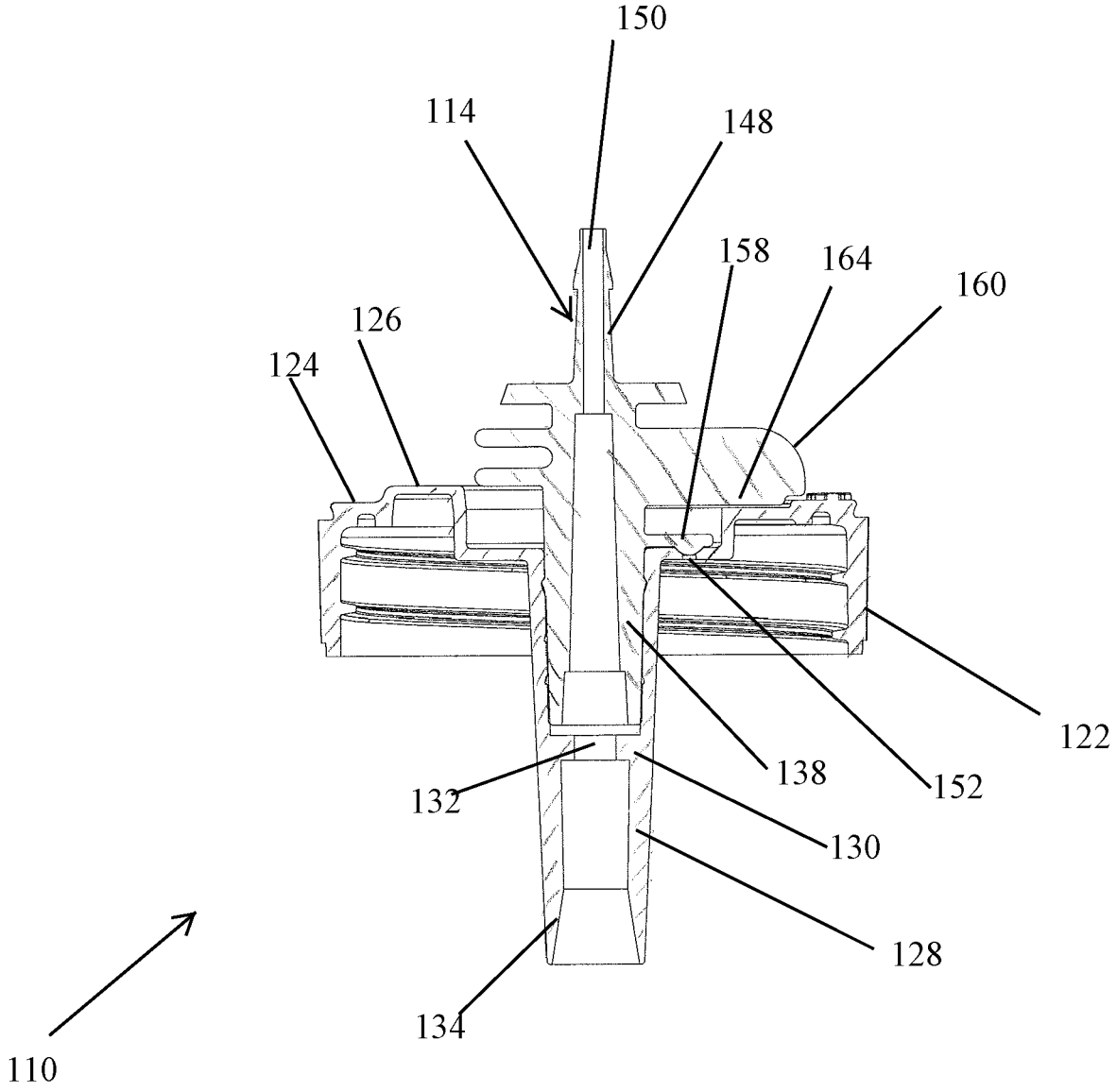
FIG. 8 is a cross-sectional view of the closure assembly showing the vent plug engaging the vent hole.

Extending downwardly from the bottom wall 130 is a sleeve wall 134 for receiving a dispensing tube (not shown), which runs to the bottom of the container. The dispensing tube provides a path through which liquid may be drawn from the bottom of the container to the tubular hub 128 so that it may be dispensed through the dispensing fitment 114 and then through the trigger sprayer. FIG. 8 shows how the sleeve wall 134, tubular hub 128, and dispensing fitment 114 provide a path for a liquid to flow from a dispensing tube received in the sleeve wall 134 and then through the dispensing fitment 114.

The dispensing fitment 114 has a fitment body 136 that can be inserted into the closure body 116 to form the closure assembly 110 shown in FIG. 7. The fitment body 136 has an arbor 138 that extends downwardly from the fitment body 136 and can be inserted into the hub 128 of the closure body 116. To secure the dispensing fitment 114 within the hub 128 of the closure body 116, the arbor 138 includes an annular locking ledge 140 on an outside surface thereof which engages with a complementary annular groove 144 formed on an inner surface 146 of the hub. When the consumer inserts the dispensing fitment 114 into the closure body 116, the locking ledge 140 snaps into place within the annular groove 144, and the ledge 140 and groove 144 together maintain the dispensing fitment 114 in assembled relation with the closure body 116. The locking ledge 140 and groove 144 are configured to allow the arbor 138 of the fitment 114 to be slidably and rotatably received in the hub 128 of the closure body.

Figure 9:
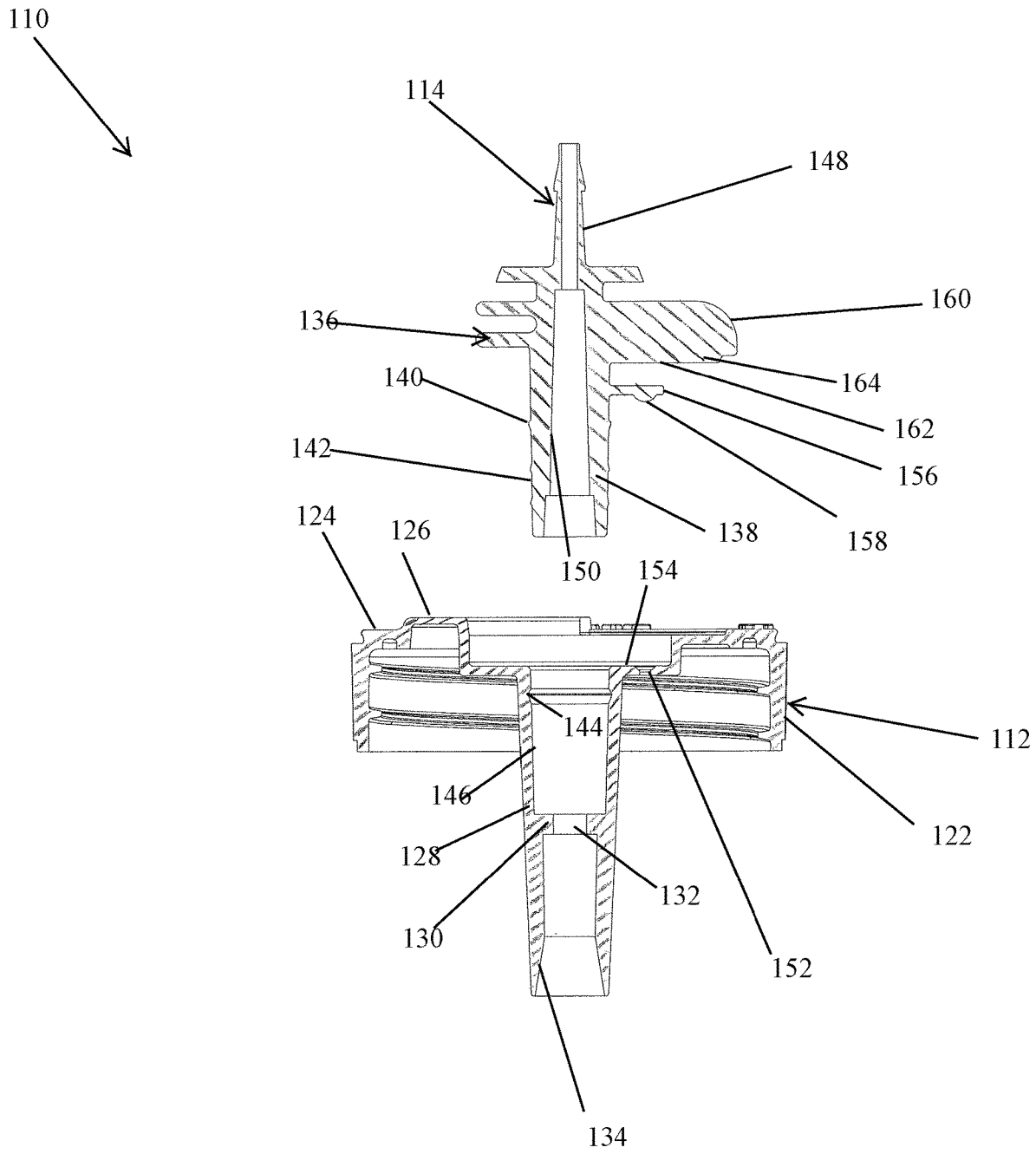
FIG. 9 is an exploded cross-sectional view of the closure assembly.

To allow the product to be dispensed from the container, a dispensing neck 148 extends upwardly from the fitment body 136, and a flow conduit 150 extends longitudinally through the arbor 138, the fitment body 136 and the dispensing neck 148, as shown in the cross sectional views of FIGS. 8 and 9. The dispensing neck 148 may be configured and arranged to receive the hose portion of a spray handle (not shown).

When a liquid volume is dispensed from a container using a trigger sprayer and air is not allowed to enter the container, the container walls begin to collapse inwards. This decreases the ability of the trigger sprayer to dispense liquid from the container, and it may cease the operation of the trigger sprayer entirely. The instant invention addresses this problem by including a sealable vent hole 152 defined on a recessed fitment seat 154 surrounding the hub 128, and radially spaced from the hub 128.

However, when using a container in a trigger spray system, it is also desirable for the user to be able to prevent bottle leakage when the liquid container is not in use. The instant invention allows the user to seal the vent hole 152 as needed to prevent inadvertent bottle leakage. As described below, the dispensing fitment 114 enables the consumer to selectively plug and open the vent hole 152 by rotating the fitment body 136 within the hub 128 of the closure body.

Figure 10:
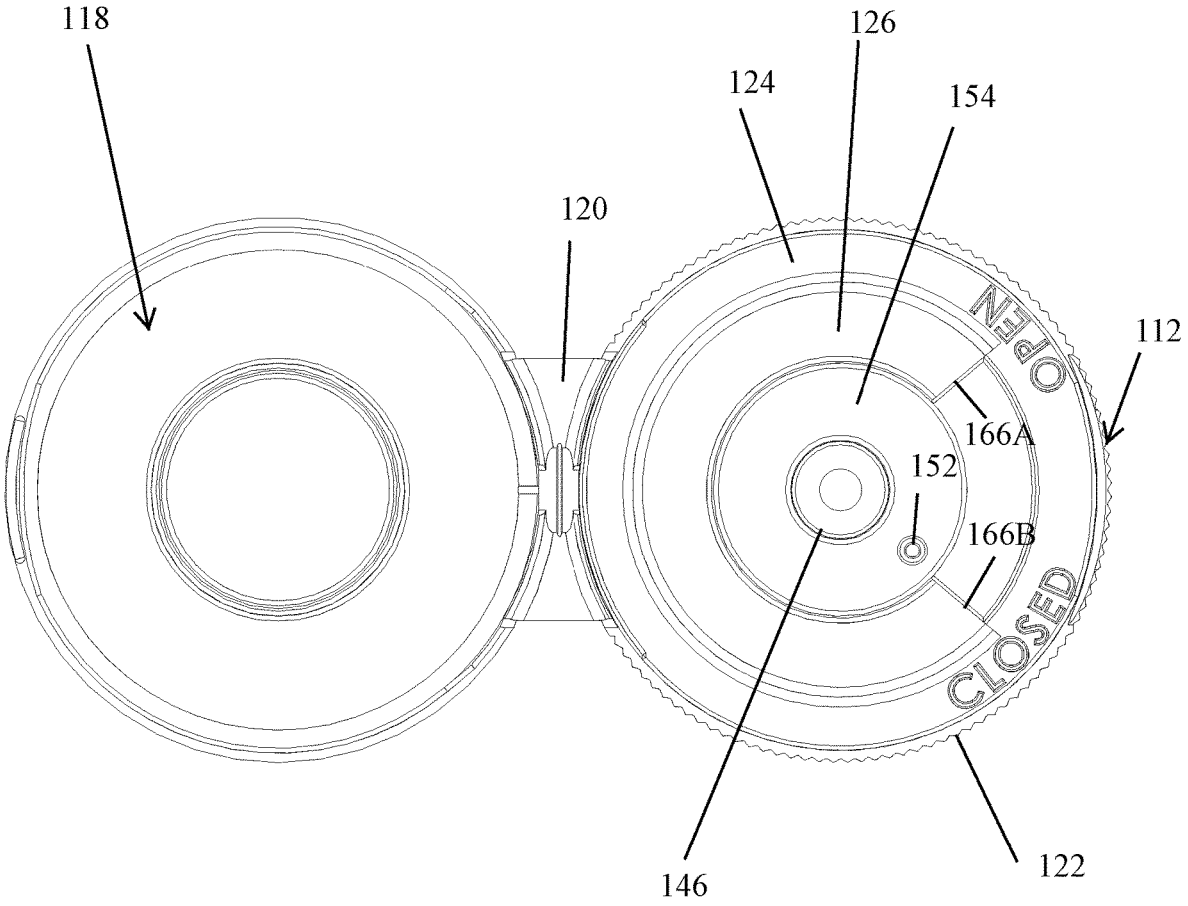
FIG. 10 is a top view of the closure with the dispensing fitment removed.
Figure 11:
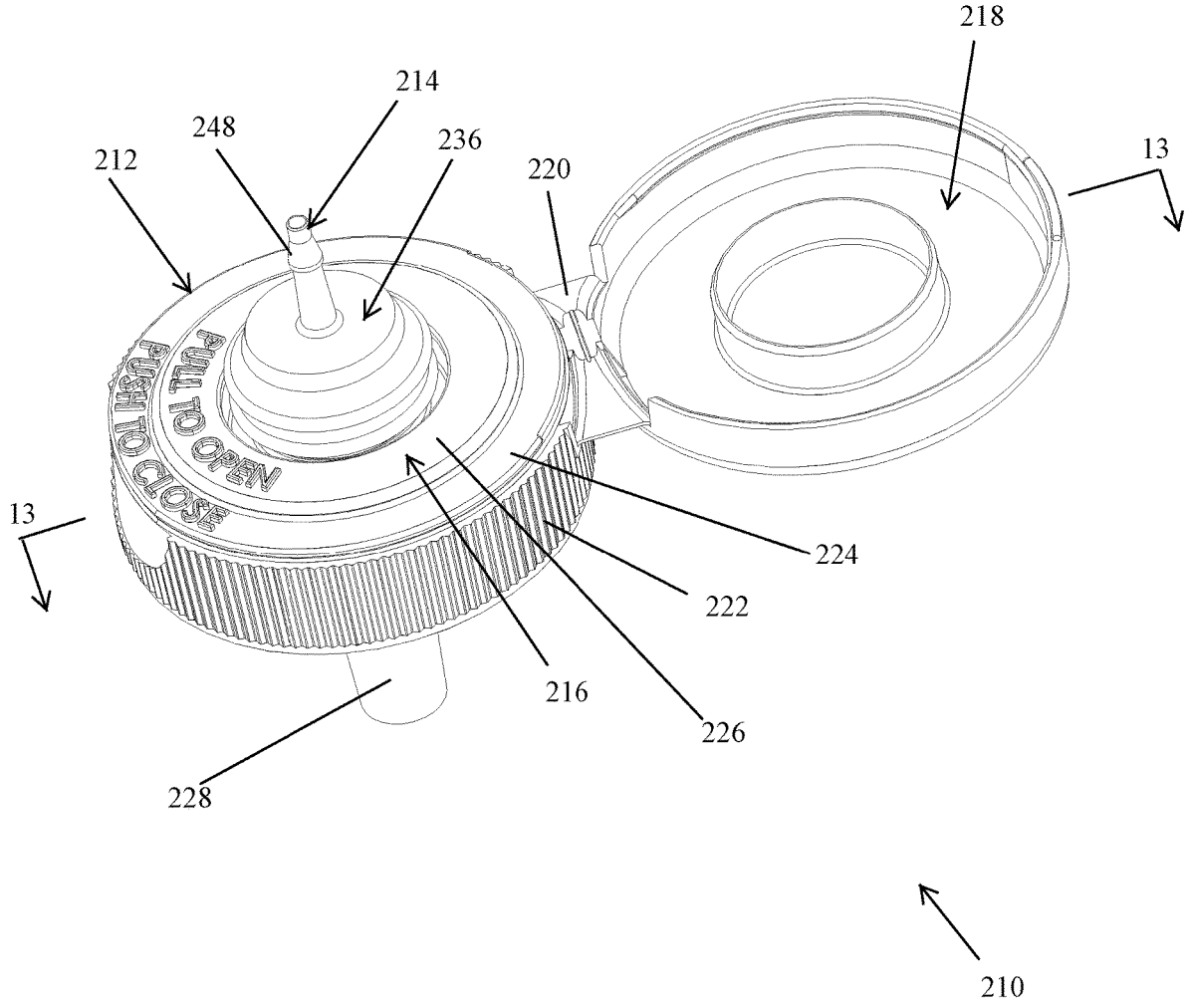
FIG. 11 is a perspective view of still another exemplary closure assembly of the present invention.

A cantilevered arm 156 extends radially outwardly from the arbor 138 of the fitment body 136, and a vent plug 158 extends downwardly from the cantilevered arm 156 so that the vent plug can be radially aligned with the vent hole. The arbor 138 is slidably and rotatably received in interfitting mating relation within the hub 128 of the closure body 116 so that the cantilevered arm is positioned in facing engagement with the recessed seat. Thus, the consumer may rotate the dispensing fitment 114 between an open venting position in which the vent plug 158 is circumferentially displaced and not engaged with the vent hole 152 and a closed position in which the vent plug 158 is circumferentially aligned and engaged with the vent hole 152. The cantilever arm 156 is flexible to provide a spring bias for firm engagement of the vent plug 158 with the vent hole 152. FIG. 10 shows the locations of the vent hole 152 and the open and closed positions on the closure body 116. FIGS. 6 and 8 show the fitment body 136 rotated to the closed position so that the vent plug 158 seals the upper end of the vent hole 152.

In order to facilitate rotation of the dispensing fitment 114 within the hub 128 of the closure body 116, the dispensing fitment 114 may include a radially extending actuator arm 160. To further facilitate rotation of the dispensing fitment 114 between the closed position and the open position, the lower surface 162 of the actuator arm may include a locating tab 164 that extends downwardly from the actuator arm 160 and engages a stop 166A corresponding to an open position and a stop 166B corresponding to the closed position. These stops 166A, 166B are positioned such that when a user rotates the actuator arm 160 until the locating tab 164 contacts the stop 166B corresponding the closed position, the vent plug 158 engages and seals the vent hole 152.

Another exemplary embodiment of the closure assembly of the instant invention is illustrated and generally shown at 210 in FIGS. 11-15. As will hereinafter be more fully described, the instant closure assembly includes a vented closure and a dispensing fitment that form a vented closure assembly with a linearly displaceable vent sealing platform (push-pull) for a container (not shown).

The closure assembly 210 of the present invention includes a closure 212 and a dispensing fitment 214 with a linearly displaceable vent sealing platform 215, which is particularly useful for spray bottles for home and garden products. The closure 212 and dispensing fitment 214 are provided separately to the consumer, with the closure 212 removably secured to a spray bottle or other container. When ready to use the product, the consumer may insert the dispensing fitment 214 into the closure 212, as described below, and then connect the hose portion of a spray handle (not shown) to the dispensing fitment 214 in order to dispense a product from the container.

FIG. 10 shows a perspective view of the closure 212 and the dispensing fitment 214 of the closure assembly 210 when fully assembled. The closure 212 has a closure body 216 and a closure cap 218, which may be connected by a living hinge 220 that allows the cap 218 to be moved from an open position to a closed position or may be two separate components capable of being snap fit or otherwise connected. The manufacturer secures the closure body 212 to a container by way of an inwardly threaded skirt 222 that extends downwardly from the closure deck 224 that engages an outwardly threaded neck portion of the container, and then the manufacturer closes the closure cap against the closure body to seal the container.

Figure 12:
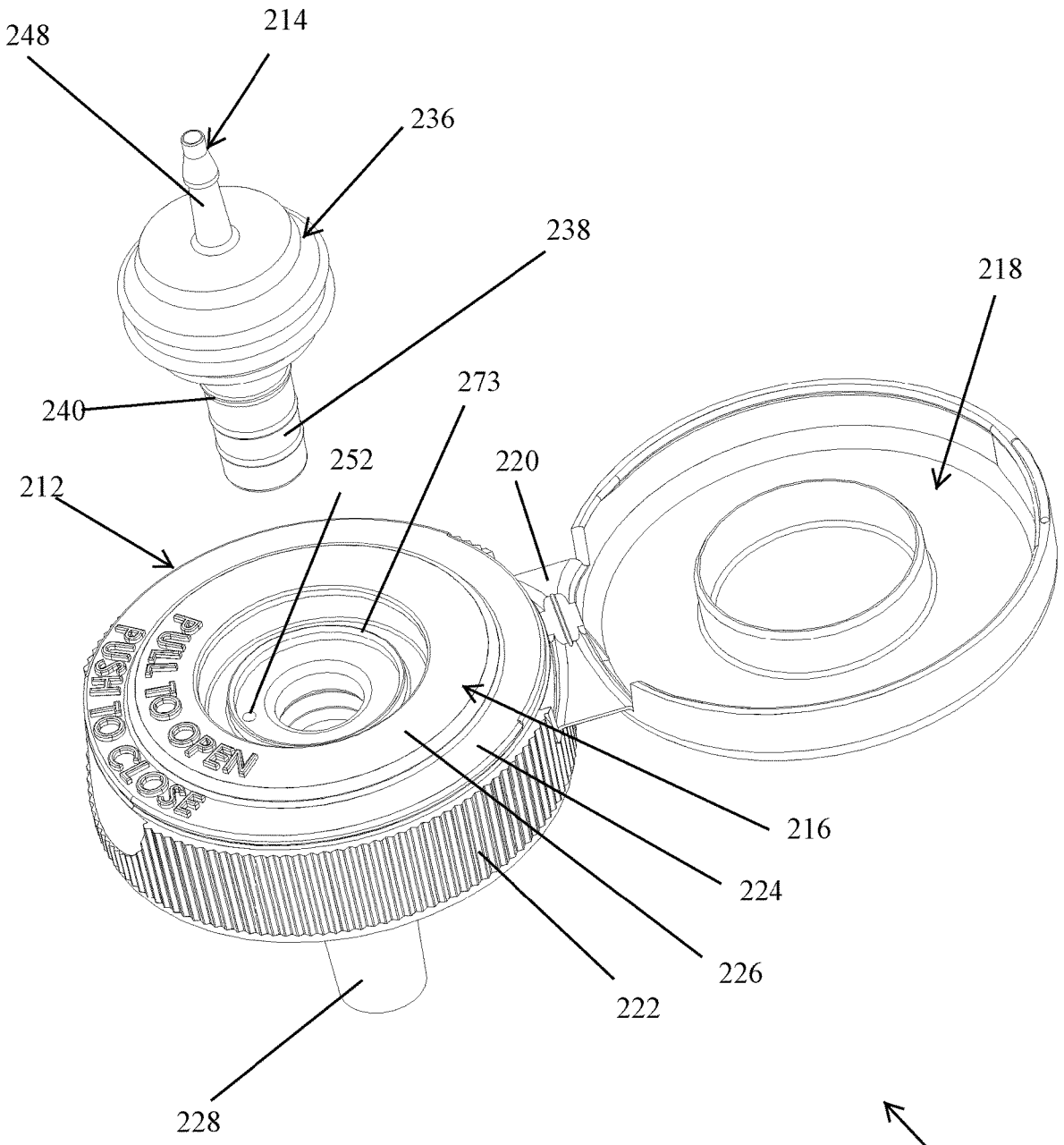
FIG. 12 is an exploded view thereof.

The closure body 216 also has an upper deck 226, and a tubular hub 228 that extends downwardly from the upper deck for receiving the dispensing fitment 214 when the closure cap is in an open position, as shown in FIG. 12. The tubular hub 228 has a bottom wall 230 and an entrance orifice 232 defined within the bottom 230 wall (see FIGS. 13 and 14).

Figure 13:
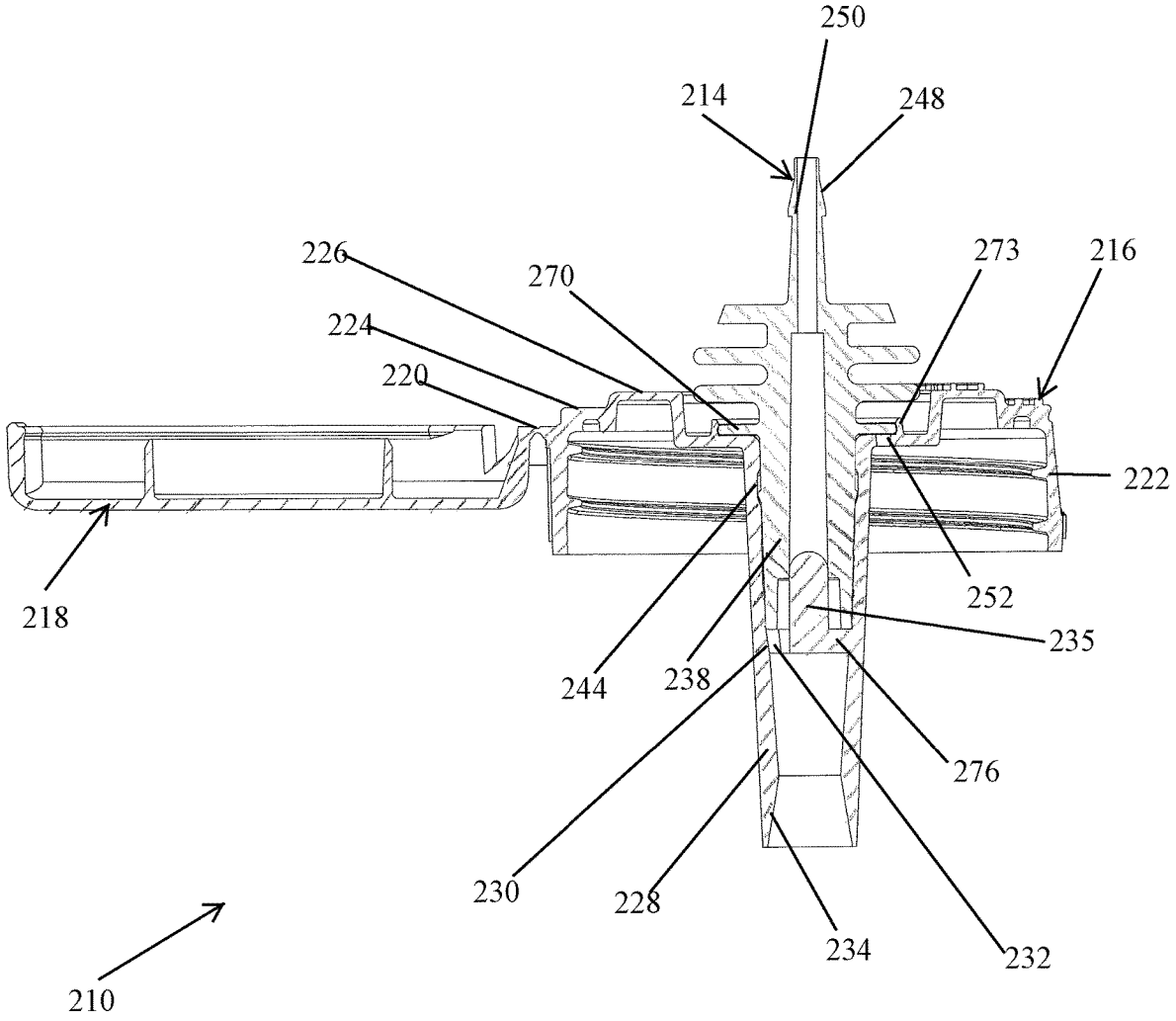
FIG. 13 is a cross-sectional view of the closure assembly showing the recessed fitment seat blocking the vent hole.

Extending downwardly from the bottom wall is a sleeve wall 234 for receiving a dispensing tube (not shown), which runs to the bottom of the container. The dispensing tube provides a path through which liquid may be drawn from the bottom of the container to the tubular hub 228 so that it may be dispensed through the fitment 214 and then through the trigger sprayer. FIG. 13 shows how the sleeve wall 234, tubular hub 228, and dispensing fitment 214 provide a path for a liquid to flow from a dispensing tube received in the sleeve wall 234 and then through the dispensing fitment 214, though this path in FIG. 13 is blocked by the sealing boss 235, which is discussed in more detail below.

The dispensing fitment 214 has a fitment body 236 that can be inserted into the closure body 216 to form the closure assembly 210 shown in FIG. 10. The fitment body 214 has an arbor 238 that extends downwardly from the fitment body 236 and can be inserted into the hub 228 of the closure body 216. To secure the dispensing fitment 214 within the hub 228 of the closure body 216, the arbor includes an annular locking ledge 240 on an outside surface 242 thereof which engages with a complementary annular groove 244 formed on an inner surface 246 of the hub. When the consumer inserts the dispensing fitment 214 into the closure body 216, the locking ledge 240 snaps into place within the annular groove 244, and the ledge 240 and groove 244 together maintain the dispensing fitment 214 in assembled relation with the closure body 216. The locking ledge 240 and groove 244 are configured to allow the arbor 238 of the fitment body 236 to be slidably received in the hub 228 of the closure body 216 and linearly displaceable within the closure body 216, as discussed in more detail below.

To allow the product to be dispensed from the container, a dispensing neck 248 extends upwardly from the fitment body 236, and a flow conduit 250 extends longitudinally through the arbor 238, the fitment body 236 and the dispensing neck 248, as shown in the cross sectional view of FIG. 13. The dispensing neck 248 may be configured and arranged to receive the hose portion of a spray handle.

When a liquid volume is dispensed from a container using a trigger sprayer and air is not allowed to enter the container, the container walls begin to collapse inwards. This decreases the ability of the trigger sprayer to dispense liquid from the container, and it may cease the operation of the trigger sprayer entirely. The instant invention addresses this problem by including a sealable vent hole 252 defined on a recessed fitment seat 254 surrounding the hub 228, and radially spaced from the hub 228.

However, when using a container in a trigger spray system, it is also desirable for the user to be able to prevent bottle leakage when the liquid container is not in use. The instant invention allows the user to seal the vent hole 252 as needed to prevent inadvertent bottle leakage. As described below, the dispensing fitment 214 enables the consumer to selectively plug and open the vent hole 252 by linearly moving the fitment body 236 within the hub 228 of the closure body 216.

Figure 15:
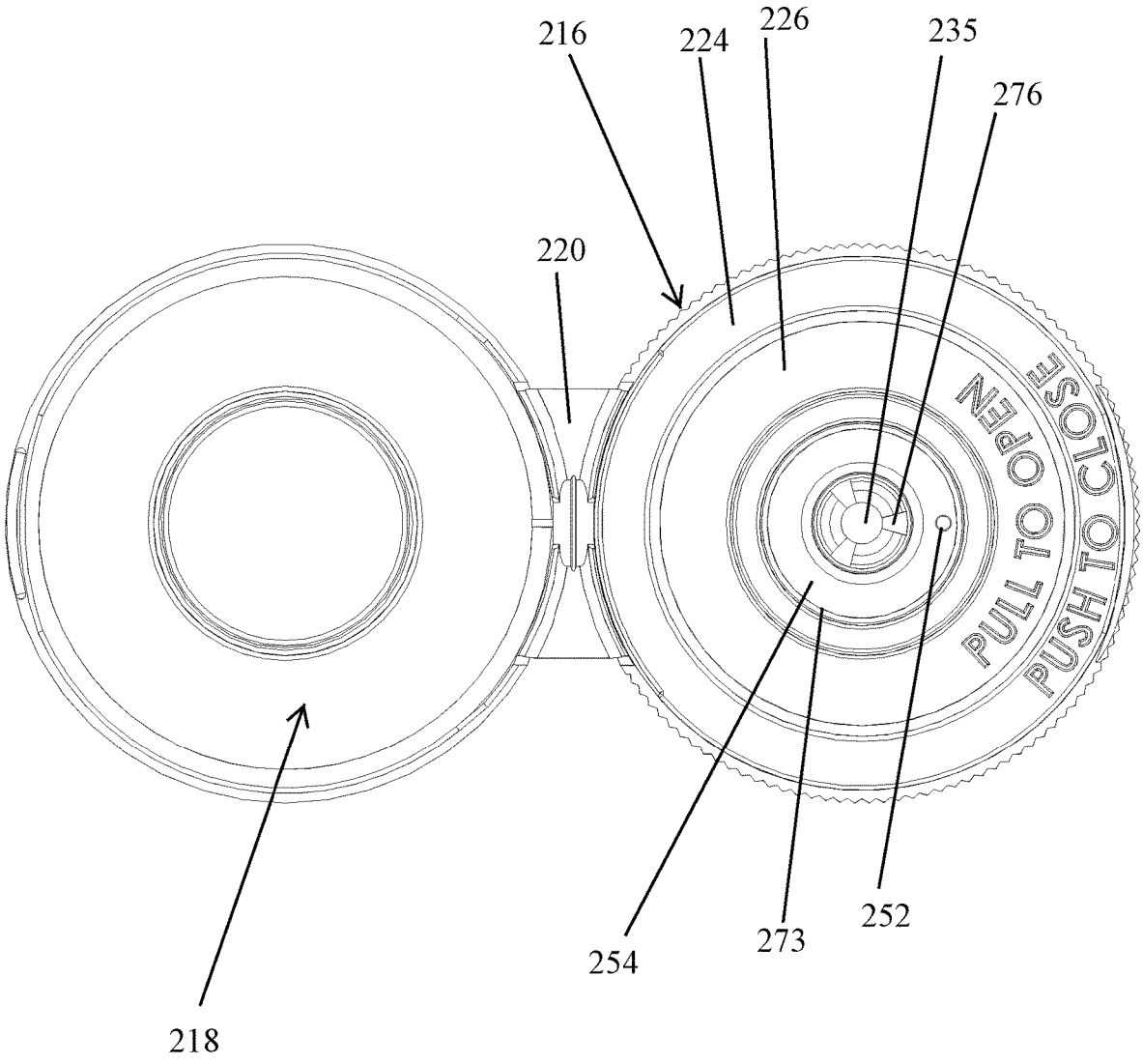
FIG. 15 is a top view of the closure with the dispensing fitment removed.

An annular sealing platform 270 extends radially outwardly from the fitment body and the annular sealing platform 270 has a lower sealing surface 272 for engaging and sealing the vent hole 252. The arbor 238 is slidably received in interfitting mating relation within the hub 228 of the closure body 216 so that the lower sealing surface 272 of the sealing platform 270 is positioned in facing engagement with the recessed seat 254. Thus, the consumer may move the dispensing fitment 214 between an open venting position in which the lower sealing surface 272 is linearly displaced upwardly and not engaged with the vent hole 252 and a closed position in which the lower sealing surface 272 engages the fitment seat 254 and blocks the vent hole 252 so that fluid may not pass through the vent hole. FIG. 15 shows the location of the vent hole 252 on the closure body 216. FIGS. 10 and 13 show the fitment body 236 in the closed position so that the lower sealing surface 272 seals the upper end of the vent hole 252.

In order to enable a user to more easily move the fitment body between the open position and closed position, the annular locking ledge 240 on the outside of the arbor 238 engages an annular groove 244 on the inner surface of the hub. The annular groove 244 has a lower edge wall 245A corresponding to the lower closed position, and an upper edge wall 245B corresponding to an open venting position. The locking ledge 240 and the groove 244 cooperate to maintain the dispensing fitment 214 in assembled relation with the closure body 216 and provide positive locating positions of the dispensing fitment 214 relative to the closure 212. FIG. 13 shows the fitment body 236 in the closed position, with the annular locking ledge 240 in contact with the lower edge 245A of the annular groove. Moving the fitment body upwardly so that the annular locking ledge 240 is in contact with the upper edge wall 245B would unseal the vent hole 252. Thus, a user may simply operate the venting mechanism of the instant invention by pushing or pulling on the fitment body 236 with respect to the closure body 216 to selectively form a sealed or vented closure.

The recessed fitment seat 254 may include an upstanding annular sealing wall 273 to secure the annular sealing platform in the closed position. The upstanding annular sealing wall 273 matingly engages with a peripheral edge 274 of the annular sealing platform 270 when the sealing platform 270 is in the closed position to create a better seal of the vent hole 252. The outer diameter of the peripheral edge 274 can be designed to be greater than the inner diameter of the upstanding annular sealing wall 273, forming a more secure press fit between peripheral edge 274 of the sealing platform 270 and sealing wall 273.

Figure 14:
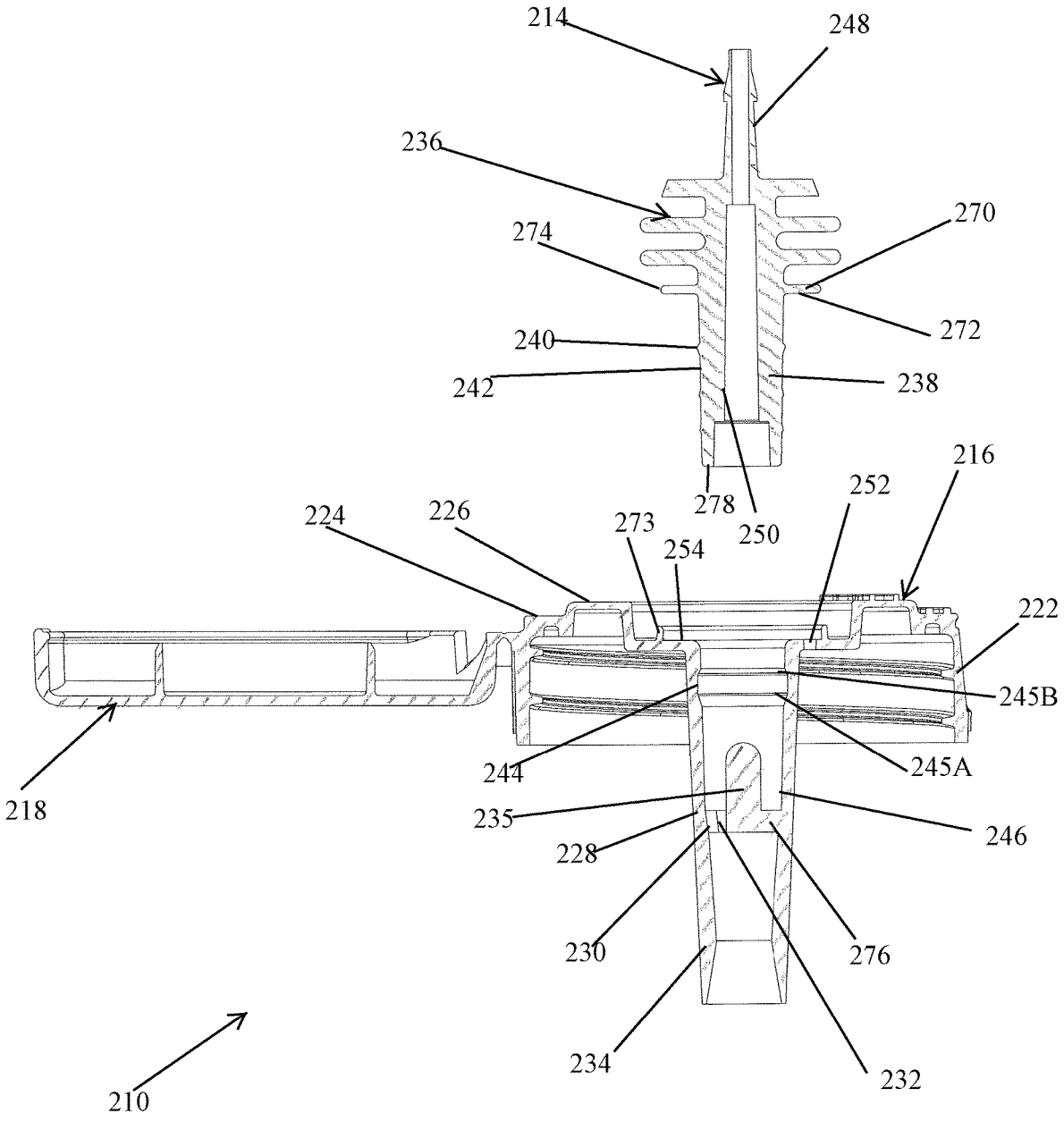
FIG. 14 is an exploded cross-sectional view of the closure assembly.

The hub 228 may further include a sealing boss 235 within the flow conduit 250, as shown in FIGS. 13 and 14. The sealing boss 235 is connected to the hub 228 by a plurality of radial connecting ribs 278. The sealing boss is positioned within the flow conduit so that it engages a lower end of the arbor when the dispensing fitment is in the closed position, as shown in FIG. 13. In this position, the sealing boss and lower end 276 of the arbor 238 cooperate to block flow through the flow conduit 250.

For these reasons outlined herein, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A closure assembly for a container of a spray system, the closure assembly comprising:

a closure; and a dispensing fitment, said closure including a closure body having an upper deck, a tubular hub extending downwardly from said upper deck, and a recessed fitment seat surrounding said tubular hub, said tubular hub having a bottom wall and an entrance orifice within said bottom wall, said tubular hub further including a sleeve wall extending downwardly from said bottom wall for receiving therein a dispensing tube, said recessed fitment seat having a vent hole radially spaced from said tubular hub, said dispensing fitment including a fitment body, an arbor extending downwardly from said fitment body, a cantilevered arm extending radially outwardly from said arbor, a vent plug extending downwardly from said cantilevered arm, said vent plug being positioned for radial alignment with said vent hole, a dispensing neck extending upwardly from said fitment body, and a flow conduit extending longitudinally through said arbor, said fitment body and said dispensing neck, said arbor being slidably and rotatably received in interfitting mating relation within said tubular hub of said closure body whereby said cantilevered arm is positioned in facing engagement with said recessed fitment seat, said dispensing fitment being rotatably movable between an open venting position where said vent plug is circumferentially displaced and not engaged with said vent hole and a closed position where said vent plug is circumferentially aligned and engaged with said vent hole, said arbor including an annular locking ledge on an outside surface thereof which engages with a complementary annular groove formed on an inner surface of said tubular hub to maintain said dispensing fitment in assembled relation with said closure body.

2. The closure assembly of claim 1 wherein said dispensing fitment includes a radially extending actuator arm.

3. The closure assembly of claim 1 wherein said dispensing fitment includes a locating tab, and said upper deck includes circumferentially spaced locating stops corresponding said to said open and closed positions.

4. The closure assembly of claim 2 wherein said dispensing fitment includes a locating tab, and said upper deck includes circumferentially spaced locating stops corresponding to said open and closed positions.

5. The closure assembly of claim 4 wherein said locating tab is formed on said actuator arm.

6. The closure assembly of claim 1 wherein said dispensing neck is configured and arranged to receive a hose portion of a spray handle.

7. The closure assembly of claim 1 further comprising a closure cap and a living hinge connecting said closure cap to said closure body whereby said closure cap is movable between an open and a closed position.

8. A closure assembly for a container of a spray system, the closure assembly comprising:

a closure; and a dispensing fitment, said closure including a closure body having an upper deck, a tubular hub extending downwardly from said upper deck, and a recessed fitment seat surrounding said tubular hub, said tubular hub having a bottom wall and an entrance orifice within said bottom wall, said tubular hub further including a sleeve wall extending downwardly from said bottom wall for receiving therein a dispensing tube, said recessed fitment seat having a vent hole radially spaced from said tubular hub, said dispensing fitment including a fitment body having an annular sealing platform extending radially outwardly thereof, said annular sealing platform having a lower sealing surface, an arbor extending downwardly from said fitment body, a dispensing neck extending upwardly from said fitment body, and a flow conduit extending longitudinally through said arbor, said fitment body and said dispensing neck, said arbor being slidably received in interfitting mating relation within said tubular hub of said closure body whereby said lower surface of said annular sealing platform is positioned in facing engagement with said recessed fitment seat, said dispensing fitment being linearly movable relative to said closure between a lower closed position wherein said lower surface of said annular sealing platform engages said recessed fitment seat and blocks said vent hole, and open venting position wherein said lower surface of said annular sealing platform is spaced upwardly from said recessed fitment seat an allowing air to pass through said vent hole, said arbor including an annular locking ledge on an outside surface thereof which engages with a complementary annular groove formed on an inner surface of said tubular hub, said annular groove having a lower edge wall corresponding to said lower closed position and an upper edge wall corresponding to said open venting position, said locking ledge and said groove cooperating to maintain said dispensing fitment in assembled relation with said closure body and providing positive locating positions of said dispensing fitment relative to said closure.

9. The closure assembly of claim 8 wherein said recessed fitment seat including an upstanding annular sealing wall which matingly engages with a peripheral edge of said annular sealing platform when in said closed position to create an improved seal for said vent hole.

10. The closure assembly of claim 8 wherein said tubular hub further includes a sealing boss within said flow conduit, said sealing boss connected to said tubular hub by a plurality of radial connecting ribs, said sealing boss engaging a lower end of said arbor when said dispensing fitment is in said closed position.

11. The closure assembly of claim 8 further including a closure cap and a living hinge connecting said closure cap to said closure body whereby said closure cap is movable between an open and a closed position.

* * * * *